US009341403B2

(12) United States Patent
Conrad et al.

(10) Patent No.: US 9,341,403 B2
(45) Date of Patent: May 17, 2016

(54) COOLER

(71) Applicant: Milwaukee Electric Tool Corporation, Brookfield, WI (US)

(72) Inventors: Cole A. Conrad, Milwaukee, WI (US); Kyle Harvey, Wauwatosa, WI (US); Timothy Janda, Kenosha, WI (US); Paul Rossetto, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 351 days.

(21) Appl. No.: 13/939,843

(22) Filed: Jul. 11, 2013

(65) Prior Publication Data

US 2014/0013789 A1 Jan. 16, 2014

Related U.S. Application Data

(60) Provisional application No. 61/670,273, filed on Jul. 11, 2012, provisional application No. 61/750,909, filed on Jan. 10, 2013.

(51) Int. Cl.

| | |
|---|---|
| ***F25D 3/08*** | (2006.01) |
| ***A45C 11/20*** | (2006.01) |
| ***A45C 13/02*** | (2006.01) |
| ***A45C 13/10*** | (2006.01) |
| ***A45C 15/00*** | (2006.01) |

(52) U.S. Cl.

CPC . *F25D 3/08* (2013.01); *A45C 11/20* (2013.01); *A45C 13/02* (2013.01); *A45C 13/1084* (2013.01); *A45C 15/00* (2013.01)

(58) Field of Classification Search

CPC ..... F25D 3/08; F25D 23/12; F25D 2303/08; F25D 2303/081; A45C 11/20; A45C 13/02; A45C 13/1084; A45C 15/00; A45C 2013/025; H04R 1/028; H04R 2205/021

USPC ..... 381/334; 62/457.1–457.8, 331

See application file for complete search history.

(56) References Cited

U.S. PATENT DOCUMENTS

| | | | |
|---|---|---|---|
| 1,005,434 | A | 10/1911 | Kinney |
| 1,296,301 | A | 3/1919 | McClure |
| 1,602,690 | A | 10/1926 | McArthur, Jr. |
| 2,504,132 | A | 4/1950 | Jones |
| 2,879,916 | A | 3/1959 | Hoffmann et al. |
| 3,387,749 | A | 6/1968 | Godshalk et al. |
| 3,482,078 | A | 12/1969 | Milne |
| 3,608,538 | A | 9/1971 | Guerrero |
| 4,351,448 | A | 9/1982 | Ingersoll et al. |
| 4,426,863 | A | 1/1984 | Gillette et al. |

(Continued)

OTHER PUBLICATIONS

Pinella, P., "Gifts for Grads, Dads, Moms and Marrieds" (May-Jun. 1984) Saturday Evening Post (1 page).

*Primary Examiner* — Vivian Chin
*Assistant Examiner* — Jason R Kurr
(74) *Attorney, Agent, or Firm* — Michael Best & Friedrich LLP

(57) ABSTRACT

A cooler includes a bottom portion and a top portion. The bottom portion includes a body defining an insulated first compartment. The top portion includes a bottom cover and a top cover. The bottom cover is operable to enclose the first compartment and includes a bottom cover body defining a second compartment. The bottom cover body includes a speaker, a power input, and an auxiliary input, and a top cover operable to enclose the second compartment. The top cover is operable to enclose the second compartment.

17 Claims, 20 Drawing Sheets

(56) References Cited

U.S. PATENT DOCUMENTS

| | | | | |
|---|---|---|---|---|
| 4,571,740 | A | 2/1986 | Kirby et al. | |
| 4,592,482 | A | 6/1986 | Seager | |
| 4,700,395 | A | 10/1987 | Long | |
| 4,741,187 | A | 5/1988 | Ethell | |
| 4,817,191 | A | 3/1989 | Adams | |
| 4,913,318 | A | 4/1990 | Forrester | |
| 4,939,912 | A | 7/1990 | Leonovich, Jr. | |
| 4,998,425 | A | 3/1991 | Hoogland | |
| 5,050,760 | A | 9/1991 | Garcia | |
| 5,144,217 | A | 9/1992 | Gardner et al. | |
| 5,169,018 | A | 12/1992 | Fiore | |
| 5,255,816 | A | 10/1993 | Trepp | |
| 5,319,937 | A | 6/1994 | Fritsch et al. | |
| 5,337,910 | A | 8/1994 | Picozza et al. | |
| 5,447,041 | A * | 9/1995 | Piechota | A45C 11/20 206/542 |
| 5,781,853 | A | 7/1998 | Johnson | |
| 5,810,168 | A | 9/1998 | Eggering | |
| 5,833,065 | A | 11/1998 | Burgess | |
| D408,225 | S | 4/1999 | Hodosh | |
| 5,901,408 | A | 5/1999 | Miller et al. | |
| 5,924,303 | A | 7/1999 | Hodosh | |
| 5,939,858 | A | 8/1999 | Dodd et al. | |
| 5,979,175 | A | 11/1999 | Ellison | |
| 6,008,621 | A | 12/1999 | Madison et al. | |
| 6,215,276 | B1 | 4/2001 | Smith | |
| 6,216,488 | B1 * | 4/2001 | Rucker | 62/457.7 |
| 6,237,767 | B1 | 5/2001 | Lee | |
| 6,244,064 | B1 | 6/2001 | Powell et al. | |
| 6,267,240 | B1 | 7/2001 | Callaway | |
| 6,305,185 | B1 | 10/2001 | Sloan | |
| 6,308,059 | B1 | 10/2001 | Domes | |
| 6,427,070 | B1 | 7/2002 | Smith | |
| 6,434,032 | B1 | 8/2002 | Romano | |
| 6,496,688 | B2 | 12/2002 | Smith | |
| 6,502,656 | B2 | 1/2003 | Weiss et al. | |
| 6,519,965 | B1 | 2/2003 | Blanchard, Sr. et al. | |
| 6,571,568 | B1 | 6/2003 | Link | |
| 6,571,949 | B2 | 6/2003 | Burrus, IV et al. | |
| 6,781,349 | B2 | 8/2004 | Kimura et al. | |
| 6,784,570 | B1 | 8/2004 | Walls et al. | |
| D496,531 | S | 9/2004 | Einav et al. | |
| 6,799,434 | B1 | 10/2004 | Hobbs, Jr. | |
| 6,851,288 | B2 | 2/2005 | Howes | |
| 6,977,481 | B2 | 12/2005 | Smith | |
| 6,980,788 | B2 | 12/2005 | Peeples | |
| 6,981,780 | B2 | 1/2006 | Einav | |
| 6,987,247 | B2 | 1/2006 | Schaffeld et al. | |
| 7,080,920 | B2 | 7/2006 | Fitzsimmons et al. | |
| 7,160,113 | B2 | 1/2007 | McConnell et al. | |
| 7,188,491 | B2 | 3/2007 | Donald, II et al. | |
| 7,246,718 | B2 | 7/2007 | Einav et al. | |
| 7,332,889 | B2 | 2/2008 | Glasgow et al. | |
| 7,466,974 | B2 | 12/2008 | Smith | |
| 7,481,065 | B2 | 1/2009 | Krieger | |
| 7,519,195 | B2 | 4/2009 | Hesketh | |
| 7,603,875 | B2 | 10/2009 | Carr | |
| 7,604,290 | B1 | 10/2009 | Giordano | |
| 7,659,696 | B2 | 2/2010 | Zeiler et al. | |
| 7,661,528 | B2 | 2/2010 | Vovan et al. | |
| 7,705,559 | B2 | 4/2010 | Powell et al. | |
| 7,735,334 | B2 | 6/2010 | Johnson | |
| 7,741,809 | B2 | 6/2010 | Zick et al. | |
| 7,743,951 | B2 | 6/2010 | Vogel et al. | |
| 7,798,886 | B1 | 9/2010 | Williamson | |
| 7,806,271 | B1 | 10/2010 | Kraska | |
| 7,823,746 | B1 | 11/2010 | McCumber | |
| 7,835,534 | B2 | 11/2010 | Cole, Jr. et al. | |
| 7,937,964 | B2 * | 5/2011 | Temple | 62/457.1 |
| 7,984,997 | B1 | 7/2011 | Sandberg | |
| 8,026,698 | B2 | 9/2011 | Scheucher | |
| 8,084,992 | B2 | 12/2011 | Scheffy et al. | |
| 8,199,958 | B2 | 6/2012 | Weir et al. | |
| 2003/0139169 | A1 | 7/2003 | Arreazola, Jr. | |
| 2003/0197014 | A1 | 10/2003 | Muchin et al. | |
| 2005/0056561 | A1 | 3/2005 | Lai | |
| 2005/0103783 | A1 | 5/2005 | Bergum et al. | |
| 2005/0156564 | A1 | 7/2005 | Krieger | |
| 2005/0225288 | A1 | 10/2005 | Cole, Jr. et al. | |
| 2005/0285560 | A1 | 12/2005 | Glasgow et al. | |
| 2006/0076379 | A1 | 4/2006 | Hussaini et al. | |
| 2006/0178172 | A1 | 8/2006 | Yuen | |
| 2008/0025544 | A1 | 1/2008 | Maldonado | |
| 2008/0031483 | A1 | 2/2008 | Hill | |
| 2008/0164842 | A1 | 7/2008 | Bergner | |
| 2008/0190914 | A1 | 8/2008 | Gibson | |
| 2009/0031750 | A1 | 2/2009 | Whillock, Sr. | |
| 2009/0049859 | A1 | 2/2009 | Moon | |
| 2009/0158770 | A1 | 6/2009 | Cohrs et al. | |
| 2009/0250365 | A1 | 10/2009 | Goto et al. | |
| 2009/0277187 | A1 | 11/2009 | McGann | |
| 2009/0308114 | A1 | 12/2009 | Cheng et al. | |
| 2010/0085745 | A1 | 4/2010 | Kristiansen et al. | |
| 2010/0126196 | A1 | 5/2010 | McCance | |
| 2010/0176762 | A1 | 7/2010 | Daymude et al. | |
| 2010/0218532 | A1 | 9/2010 | Beliczynski | |
| 2010/0263398 | A1 | 10/2010 | Webb | |
| 2010/0275641 | A1 | 11/2010 | Manner et al. | |
| 2010/0275642 | A1 | 11/2010 | Klettner | |
| 2011/0006729 | A1 | 1/2011 | Matthias et al. | |
| 2011/0030413 | A1 | 2/2011 | Heil | |
| 2011/0260556 | A1 | 10/2011 | Partridge et al. | |
| 2012/0025766 | A1 | 2/2012 | Reade et al. | |

* cited by examiner

COOLER

CROSS-REFERENCE TO RELATED APPLICATIONS

The present application claims priority to U.S. Provisional Application 61/670,273, filed on Jul. 11, 2012, and U.S. Provisional Application 61/750,909, filed on Jan. 10, 2013, the entire contents of which are incorporated herein by reference.

BACKGROUND

The present invention relates to, in one aspect, a cooler including at least one interior compartment and at least one audio speaker.

Insulated coolers are well known, and are used to transport and store food and beverages. Also well-known are battery-powered speakers for receiving and outputting an audio input from an external device (e.g., an MP3 player, CD player, phone, etc.). A single device serving both purposes is needed.

SUMMARY

In one construction, the invention provides a cooler comprising a bottom portion and a top portion. The bottom portion includes a body defining an insulated first compartment. The top portion includes a bottom cover and a top cover. The bottom cover is operable to enclose the first compartment and includes a bottom cover body defining a second compartment. The bottom cover body includes a speaker, a power input, and an auxiliary input, and a top cover operable to enclose the second compartment. The top cover is operable to enclose the second compartment.

In another construction the invention provides a cooler comprising a bottom portion and a top portion. The bottom portion includes a body defining an insulated first compartment. The top portion includes a bottom cover and a top cover. The bottom cover is operable to enclose the first compartment and includes a cover body defining a second compartment. The cover body includes a battery receptacle formed in the cover body, a speaker, a power output operable to provide power to a secondary device, and an auxiliary input. The top cover is operable to enclose the second compartment.

Other aspects of the invention will become apparent by consideration of the detailed description and accompanying drawings.

Before any constructions of the invention are explained in detail, it is to be understood that the invention is not limited in its application to the details of construction and the arrangement of components set forth in the following description or illustrated in the following drawings. The invention is capable of other constructions and of being practiced or of being carried out in various ways.

DETAILED DESCRIPTION

Figure 1:
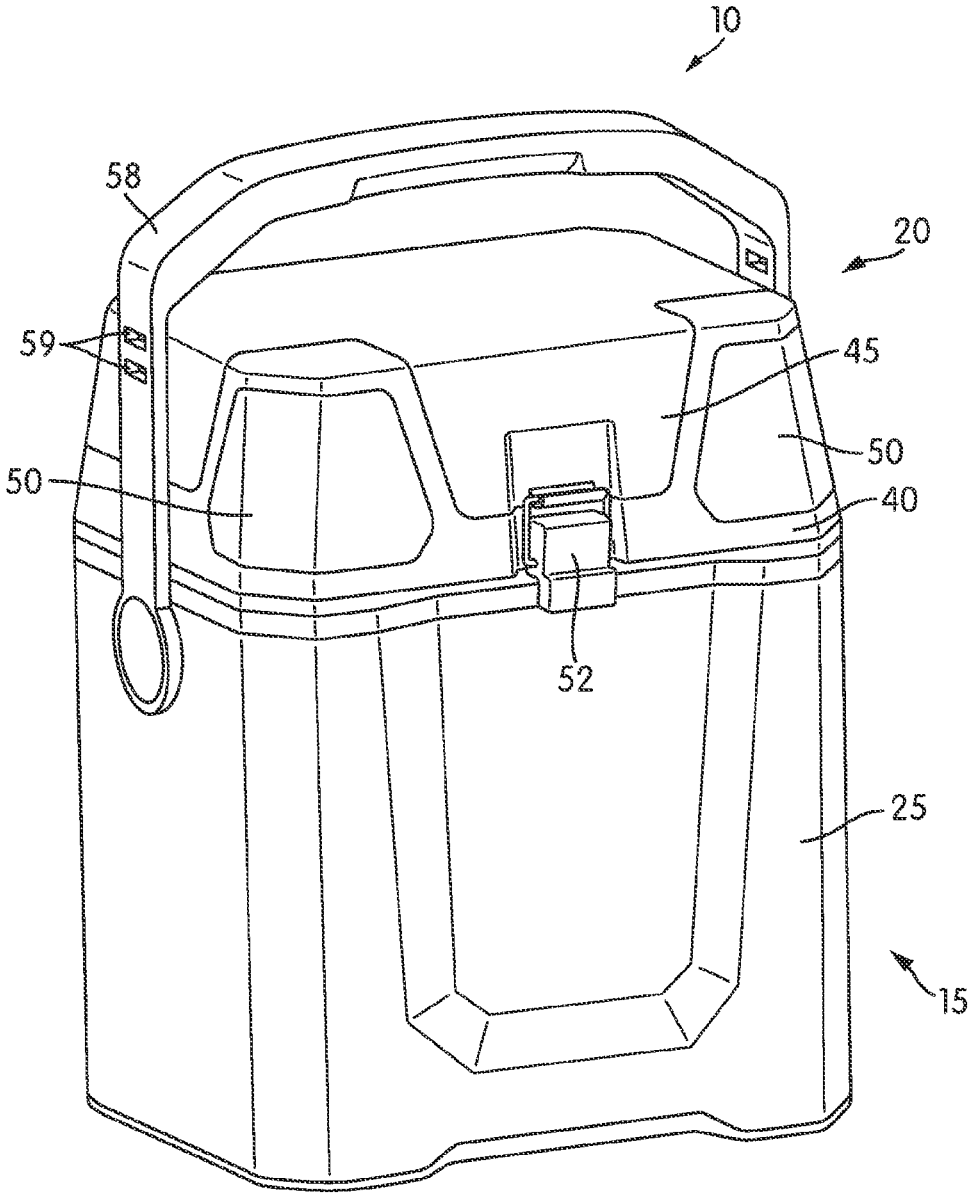
FIG. 1 is a front perspective of a cooler according to one construction of the invention.
Figure 2:
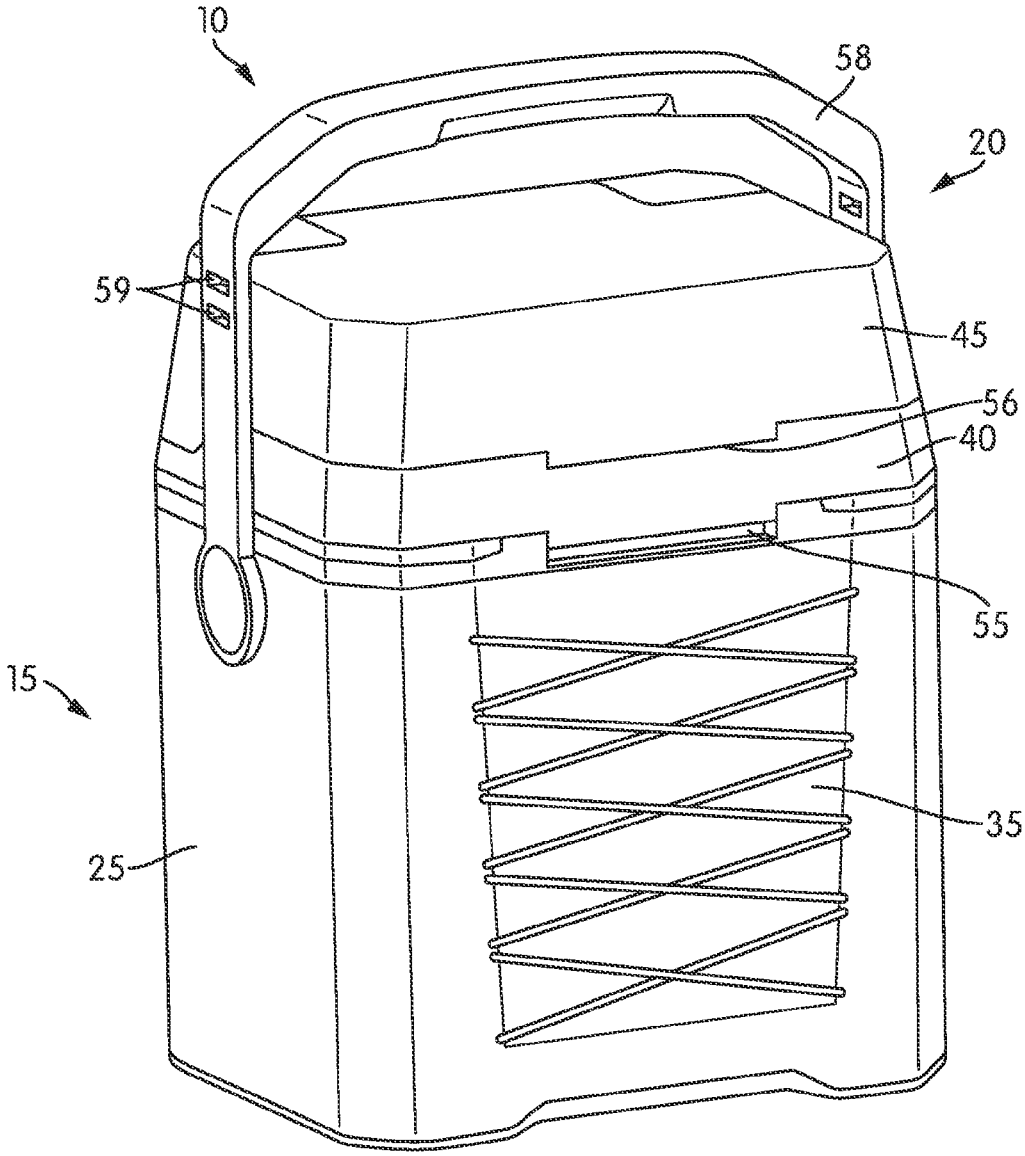
FIG. 2 is a back perspective of the cooler shown in FIG. 1.
Figure 3:
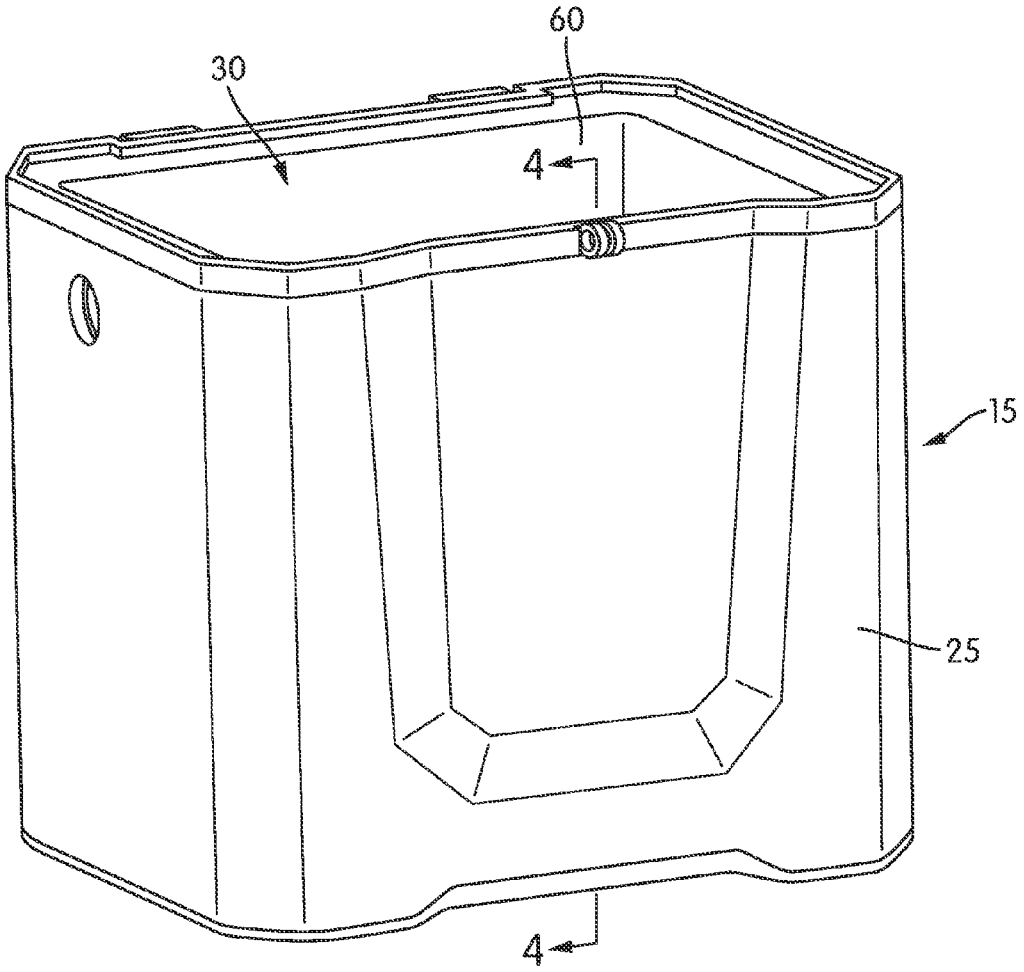
FIG. 3 is a front perspective view of a bottom portion of the cooler shown in FIG. 1, with an upper portion removed.

FIGS. 1 and 2 illustrate a cooler 10 according to one construction of the invention. The cooler 10 includes a bottom portion 15 and an upper portion 20. The bottom portion 15 includes a body 25 defining an insulated interior compartment 30 (FIG. 3). The insulated interior compartment 30 is at least used for food storage. The bottom portion 15 further includes elastic webbing 35, which can be used for extra storage. The upper portion 20 includes a bottom cover 40 and an upper cover 45. The upper portion 20 is pivotly coupled to the body 25 of the bottom portion 15 by a first hinge 55. The upper cover 45 is pivotly coupled to the bottom cover 40 by a second hinge 56.

The cooler 10 further includes a handle 58, which is used to transport the cooler 10. The handle 58 is rigid and composed of a hard plastic or a similar rigid material. In the illustrated construction, the handle 58 is movably coupled to the bottom portion 15 between a first position (FIGS. 1 and 2) for transporting the cooler 10, and a second position (FIGS. 5 and 6) in which the various compartments of the cooler 10 are accessible. The handle 58 includes spaced apart apertures 59 through which opposite ends of a flexible strap (not shown) may protrude. The ends of the flexible strap, in turn, may be anchored to the handle 58 (e.g., using buckles, etc.) to permit a user to carry the cooler 10 with the flexible strap.

Figure 4:
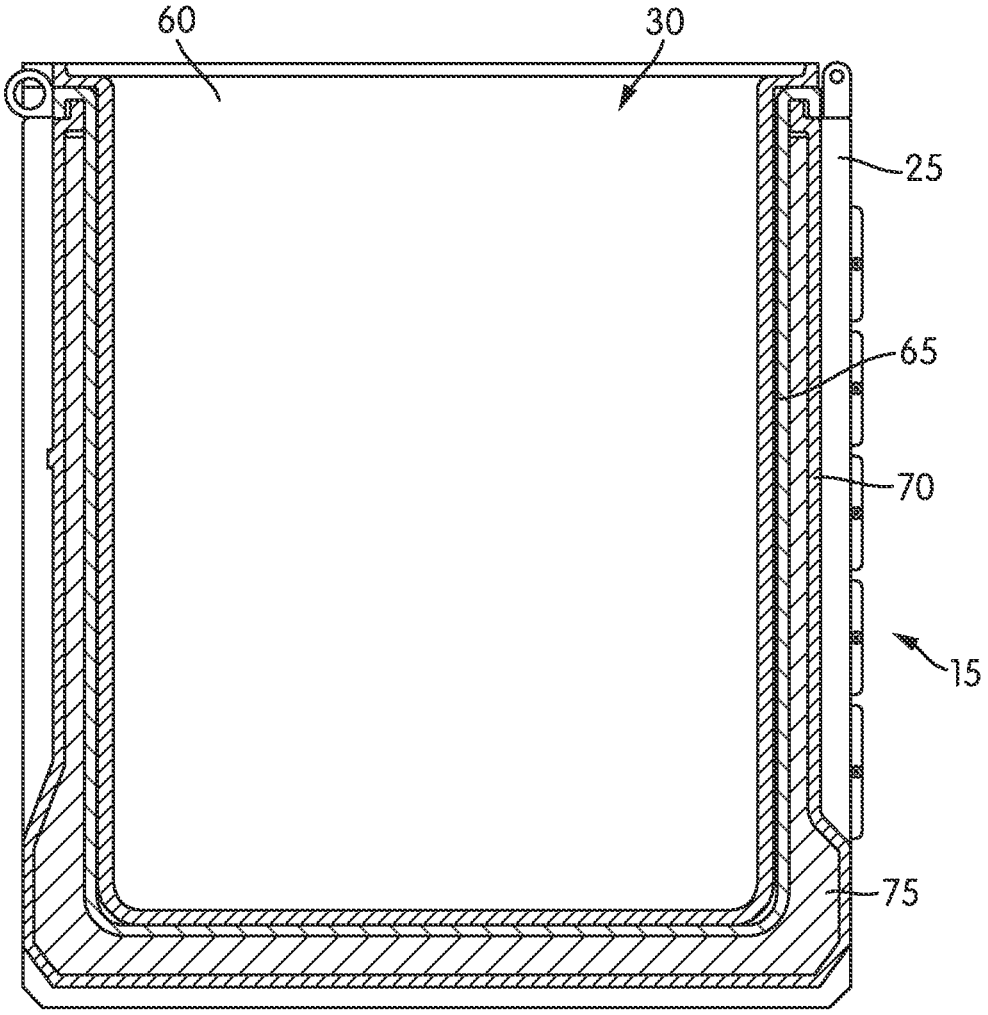
FIG. 4 is a cross-sectional view of the bottom portion taken along section line 4-4 of FIG. 3.

With reference to FIGS. 3 and 4, the insulated interior compartment 30 includes a removable liner 60, an inner cooler bucket 65, an outer cooler bucket 70, and an insulating core 75 between the two buckets 65, 70. In one construction, the liner 60 is made of plastic or a similar water proof material. The liner 60 is removably nested within the inner cooler bucket 65. The core 75 is made of insulating foam or a similar insulating material, and is nested between the inner cooler bucket 65 and the outer cooler bucket 70. In another construction, the insulating core 75 is replaced by an air gap between the inner cooler bucket 65 and outer cooler bucket 70.

Figure 5:
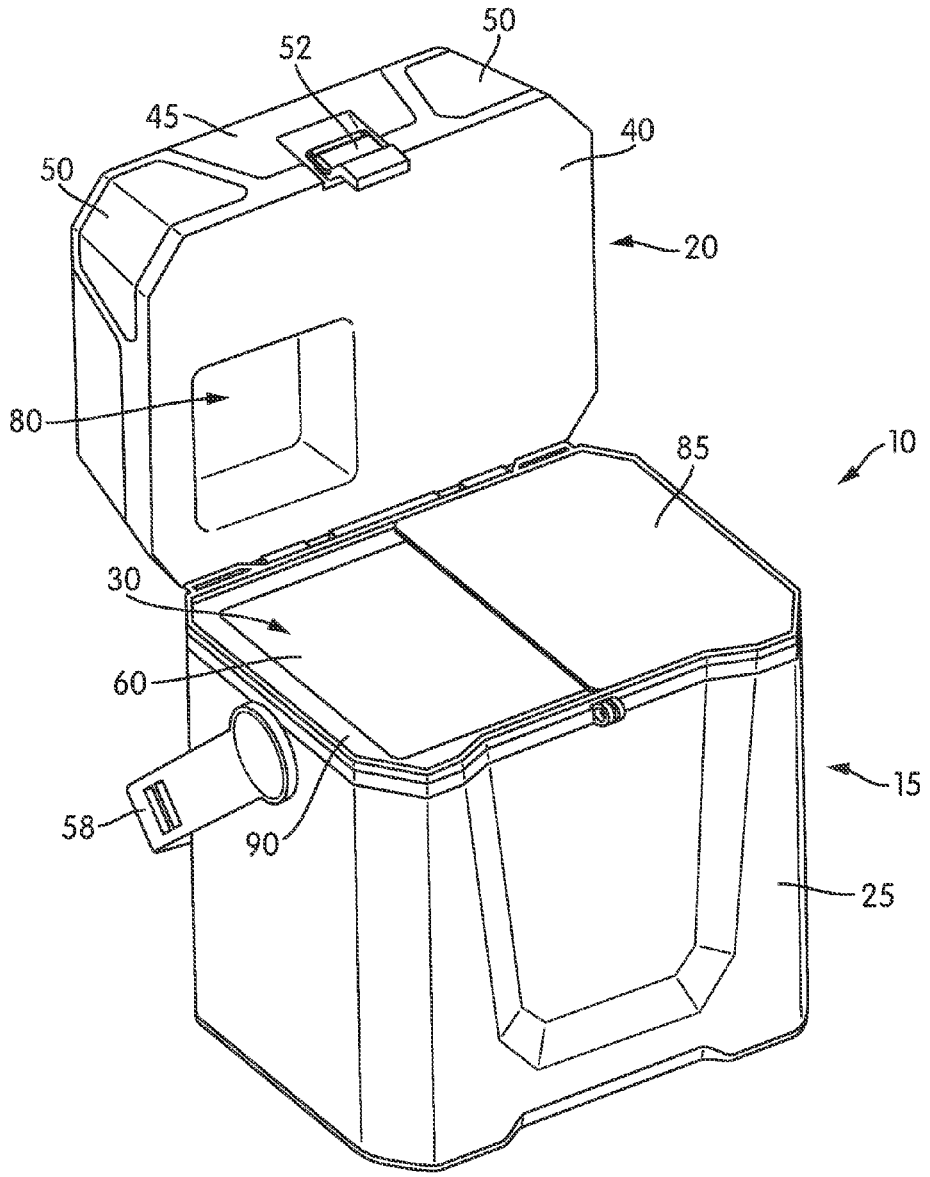
FIG. 5 is a front perspective view of the cooler shown in FIG. 1 with the upper portion in an open position, thereby exposing an insulated interior compartment.
Figure 6:
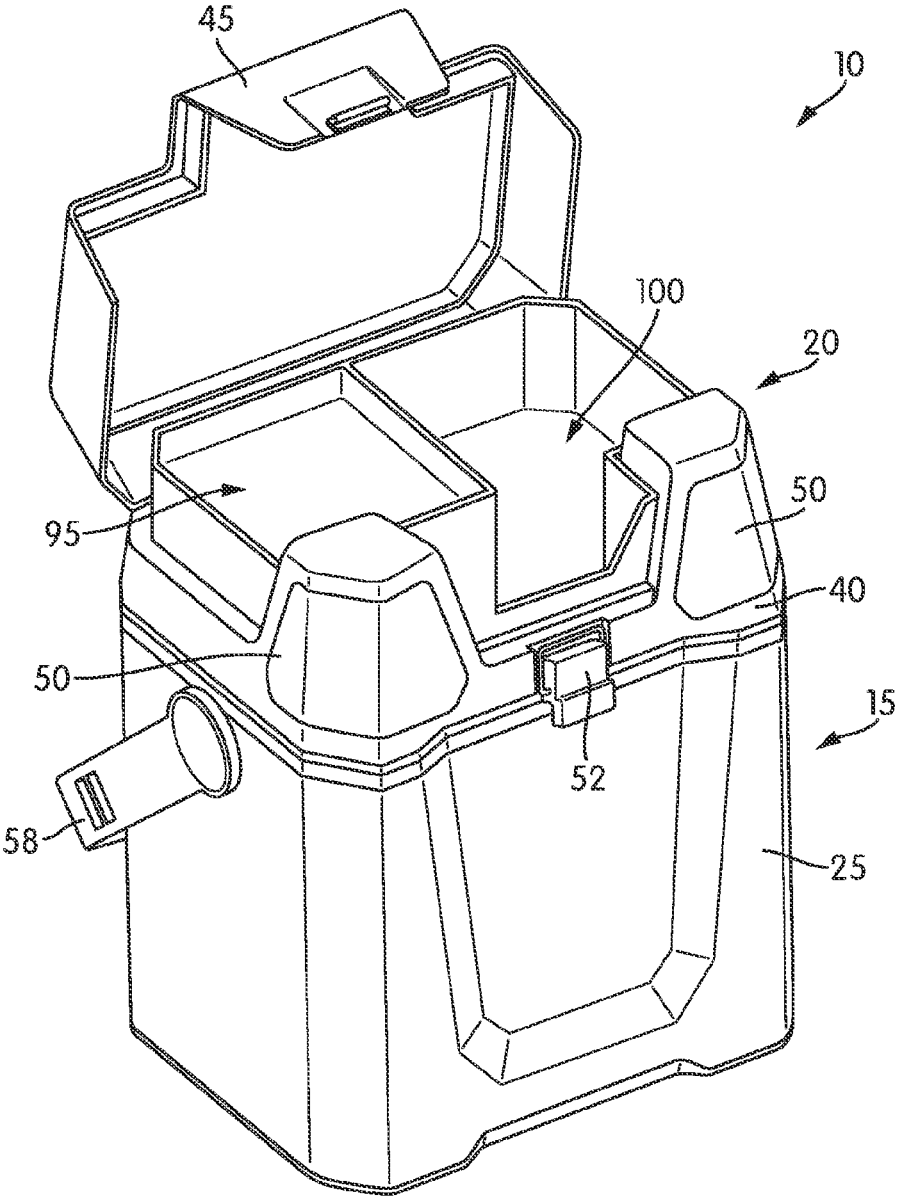
FIG. 6 is a front perspective view of the cooler shown in FIG. 1 with an upper cover in an open position, thereby exposing a dry storage compartment and a battery storage compartment.

As illustrated in FIGS. 5 and 6, the upper portion 20 encloses the interior compartment 30 of the cooler 10. The upper portion 20 further includes a recessed portion 80, which allows for tall items, such as a two-liter soda bottle, to be stored in the interior compartment 30.

As shown in FIG. 5, in one construction, the cooler 10 further includes a removable prep tray 85. The prep tray 85 may be used to prepare food items. In one construction the prep tray 85 is made of a rigid plastic or a similar rigid material. In another construction, the prep tray 85 is made of wood. As shown in the illustrated construction, the prep tray 85 sits on an edge 90 of the removable liner 60.

Figure 8:
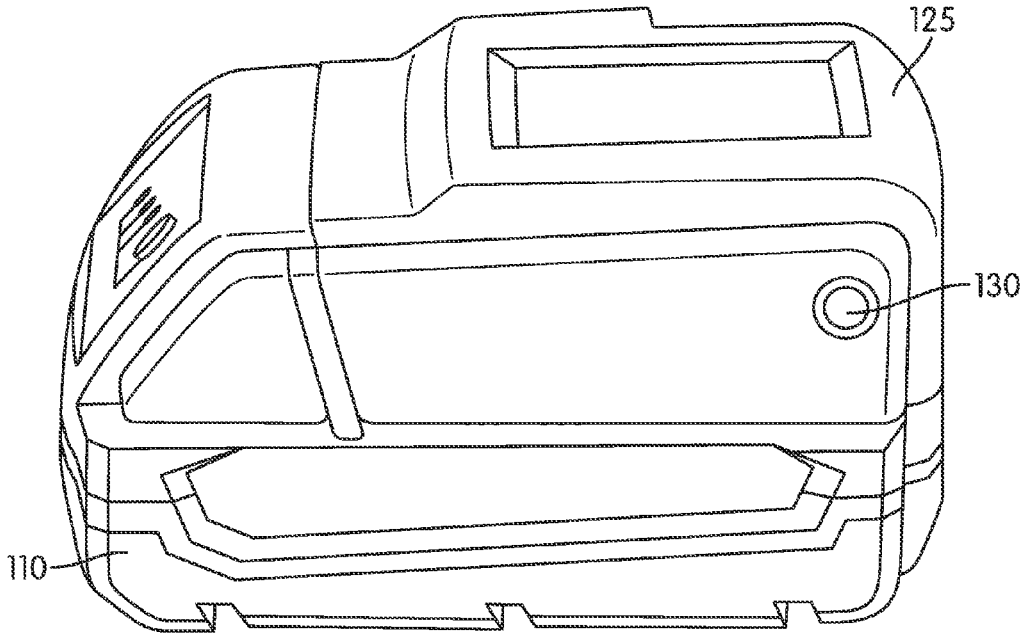
FIG. 8 is a perspective view of a battery receptacle and a battery pack removably coupled to the battery receptacle.

As shown in FIG. 6, the bottom cover 40 includes one or more speakers 50, a dry storage compartment 95, and a battery storage compartment 100. The speakers 50 can be any electroacoustic transducer or transducers that produce sound in response to a received audio signal. The dry storage compartment 95 may be used to store items that must remain dry, such as a music device 105 (FIG. 9), wallet, etc. The battery storage compartment 100 may be used to store a battery pack 110 (FIG. 8). The dry storage compartment 95 and the battery storage compartment 100 are enclosed by the upper cover 45. In the illustrated construction, the dry storage compartment 95 and the battery storage compartment 100 are substantially water proof storage areas. In another construction, the bottom cover 40 includes only one storage area, which may be used to store the music device 105 and the battery pack 110. In another construction, the bottom cover 40 includes three or more storage areas.

The battery storage compartment 100 stores the battery pack 110 (FIG. 8). The battery pack 110 includes at least one battery cell. The battery cell may be any type of battery, including any rechargeable battery. In the illustrated construction of FIG. 8, the battery pack 110 is an 18-volt lithium-ion rechargeable power tool battery pack. Alternatively, the battery pack 110 may yield any number of different output voltages (e.g., 12 volts, 14.4 volts, etc.). Additionally or alternatively, the battery pack 110 may include chemistries other than lithium-ion such as, for example, nickel cadmium, nickel metal-hydride, or the like.

Figure 7:
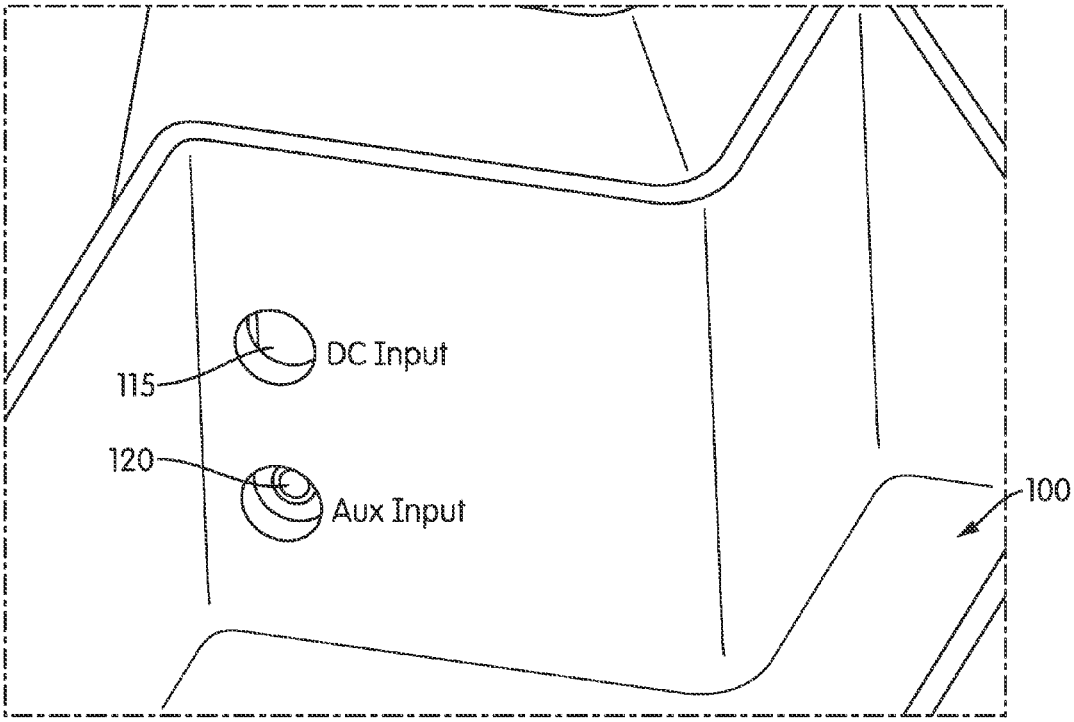
FIG. 7 illustrates a power input and an auxiliary input located within the battery storage compartment of the cooler.

As illustrated in FIG. 7, the battery storage compartment 100 includes a power input 115 and an auxiliary input 120. The power input 115 receives DC power from the battery pack 110 to power the speakers 50. The auxiliary input 120 receives audio from the music device 105.

FIG. 8 illustrates a battery receptacle 125. In the illustrated construction, the battery receptacle 125 slidingly engages the battery pack 110. The battery receptacle 125 receives DC power from the battery pack 110 and outputs the DC power to the power input 115 of the cooler 10. The battery receptacle 125 includes one or more power outputs 130. One of the power outputs 130 is electrically coupled to the power input 115 in order to provide power to the speakers 50. The other power output 130 is electrically coupled to the music device 105 to provide power to and charge the music device 105. In some constructions, the power outputs 130 may be a USB port or any of a number of different ports traditionally used for transmitting power.

Figure 9:
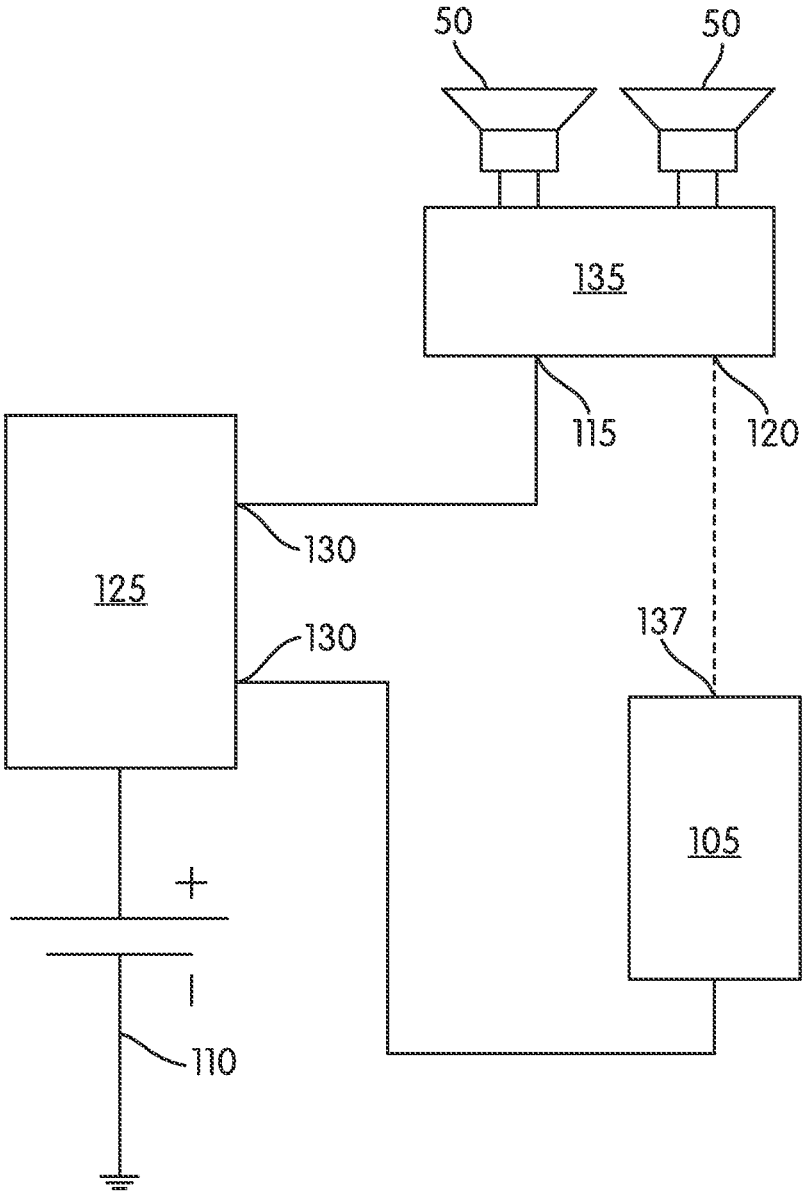
FIG. 9 is a circuit diagram of electrical components of the cooler shown in FIG. 1.

FIG. 9 is a circuit diagram of the electrical components of the cooler 10. The battery receptacle 125 receives power from the battery pack 110. The power is then outputted through the power outputs 130. Power outputs 130 may include one or more different outputs. In one construction, a speaker amplifier 135 receives power from one of the power outputs 130, which then powers the speakers 50. The music device 105 also receives power from another one of the power outputs 130, thus charging the music device 105. The output voltage of the power outputs 130 can vary depending on the connected device. For example, the output voltage of a power output 130 connected to the speaker amplifier 135 may be 12-volts, while the output voltage of a power output 130 connected to the music device 105 may be 5-volts. The speaker amplifier 135 further receives audio through the auxiliary input 120 from an auxiliary output 137 of the music device 105.

Figure 10:
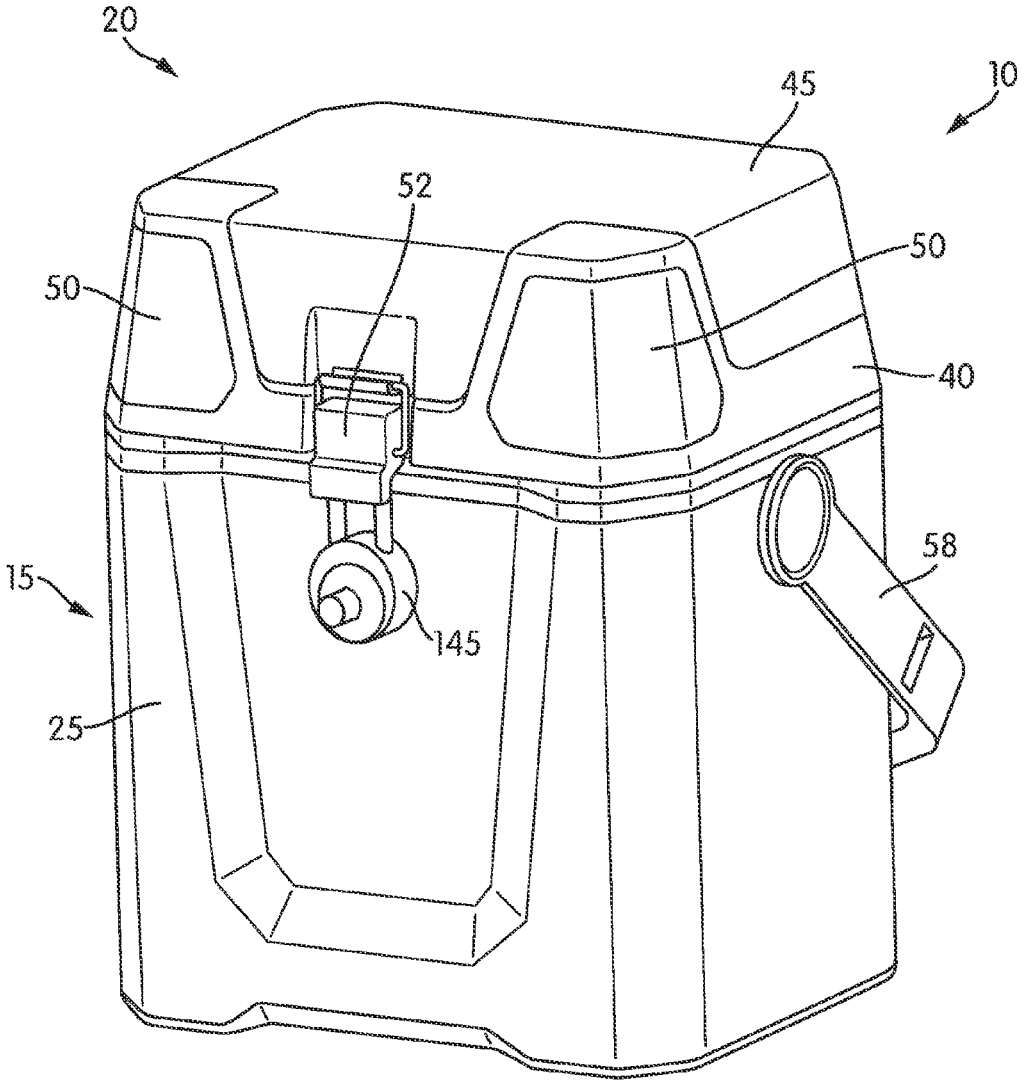
FIG. 10 is a front perspective view of the cooler shown in FIG. 1 further illustrating a latch and a lock.
Figure 11:
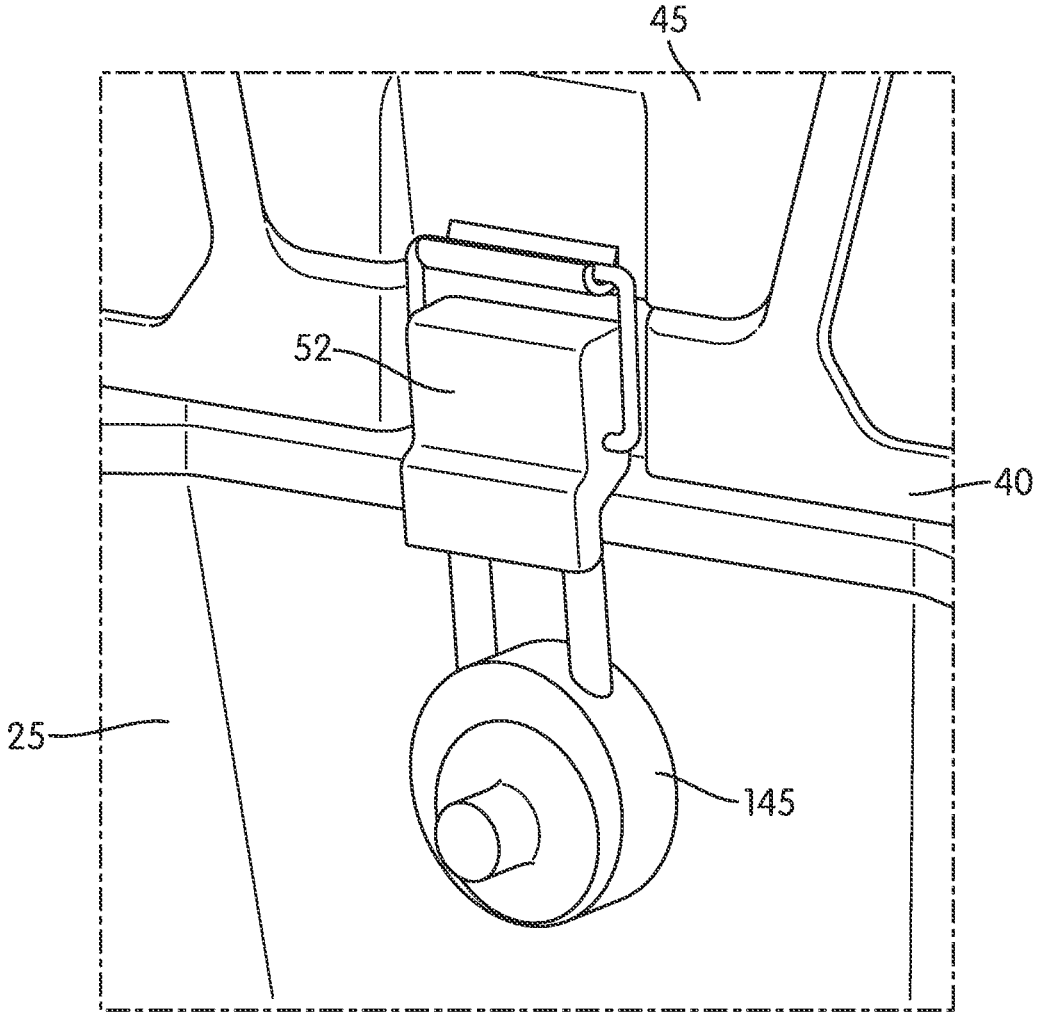
FIG. 11 illustrates the latch and the lock shown in FIG. 10.

FIGS. 10 and 11 illustrate a latch 52 of the cooler 10. The latch 52 is used to secure the upper cover 45 to the bottom cover 40, as well as the upper portion 20 to the bottom portion 15. In the illustrated construction the latch 52 is a draw latch. However, any other latch may be used, such as, a bolt lock latch, a compression latch, etc. As illustrated in FIG. 11, optionally, a lock 145 may be used in combination with the latch 52. The lock 145 and latch 52 secure items stored within the insulated interior compartment 30 as well as the other compartments 95, 100 of the bottom cover 40. In another construction, the lock 145 is integrally formed with the latch 52.

Figure 17:
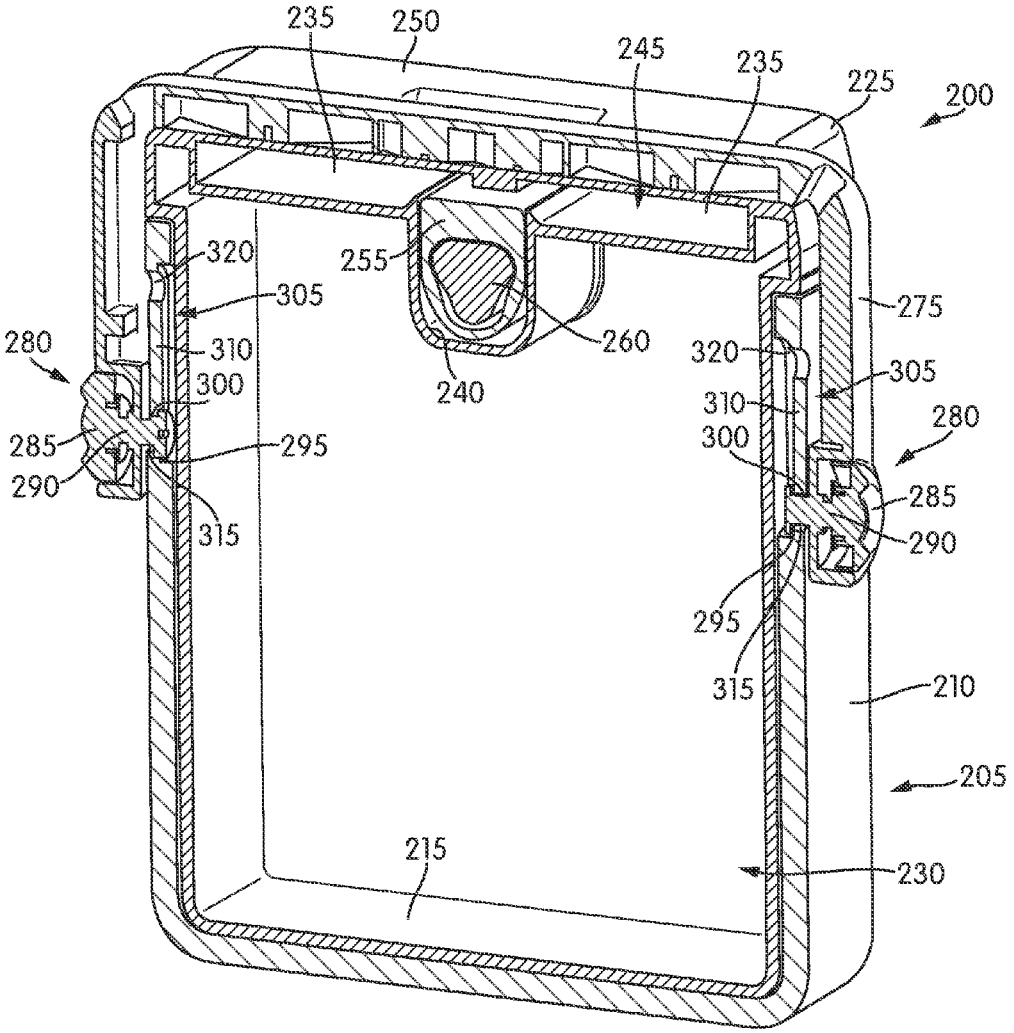
FIG. 17 is a cross-sectional view of the cooler taken along section line 17-17 of FIG. 13.
Figure 18:
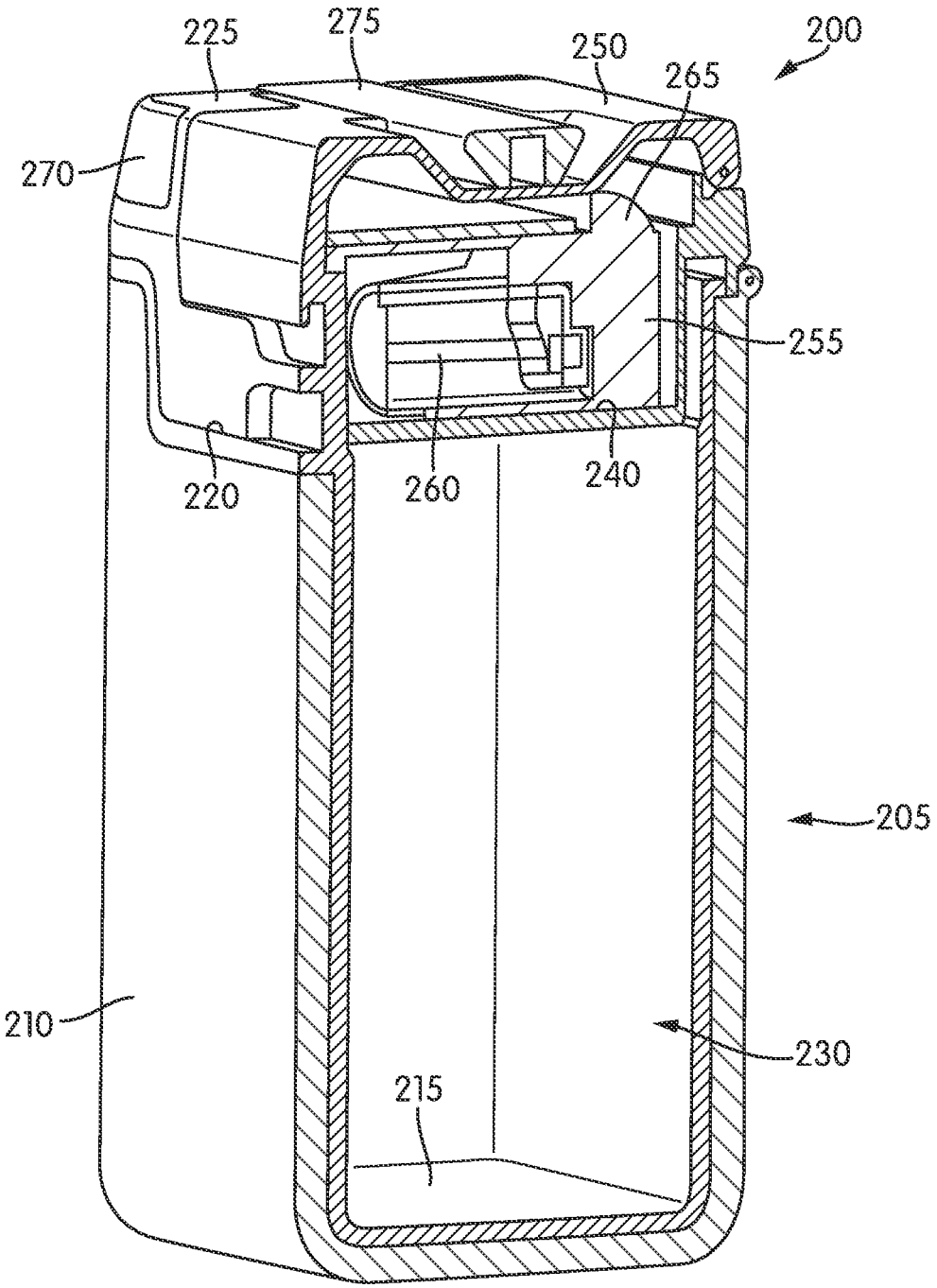
FIG. 18 is another cross-sectional view of the cooler taken along section line 18-18 of FIG. 13.

FIGS. 12-15 illustrate a cooler 200 according to another construction of the invention. The cooler 200 includes a body 205 having an outer shell 210 and an inner liner 215 nested within the outer shell 210. As illustrated in FIGS. 17 and 18, an air gap may exist between the shell 210 and the liner 215 to increase the insulation factor of the cooler 200. In the illustrated construction of the cooler 200, a height of the body 205 is sufficient to adequately stow a two-liter soda bottle. Further, a front surface of the body 205 includes a recess or notch 220 to facilitate access to items stored within the cooler 200. The cooler 200 is also sufficiently tall to function as a stool upon which an individual may sit. Alternatively, the cooler 200 may be configured having any of a number of different sizes, shapes, and/or capacities.

Figure 19:
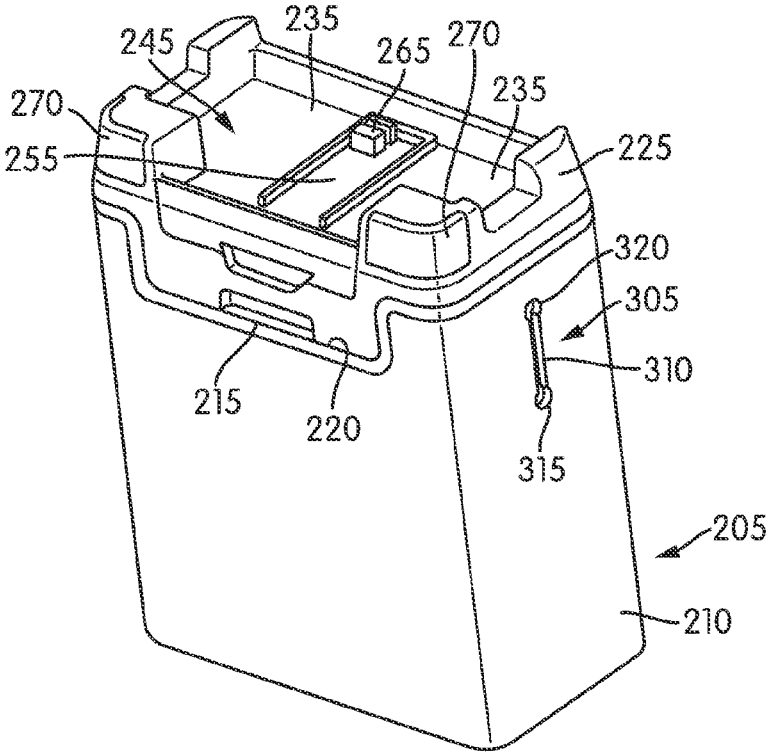
FIG. 19 is a front perspective view of the cooler of FIG. 12 with the top cover and a handle assembly shown removed, thereby exposing a bottom cover of the cooler.
Figure 20:
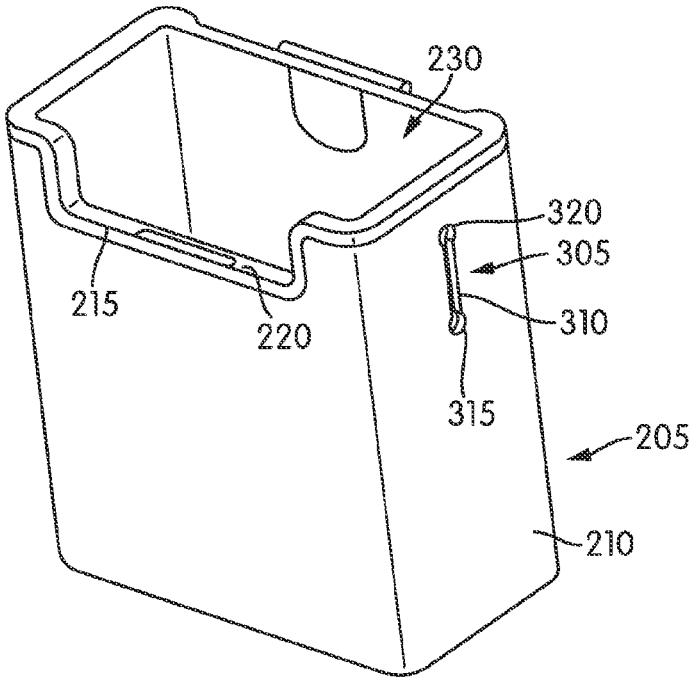
FIG. 20 is a front perspective view of the cooler of FIG. 19 with the bottom cover and the battery receptacle shown removed.
Figure 21:
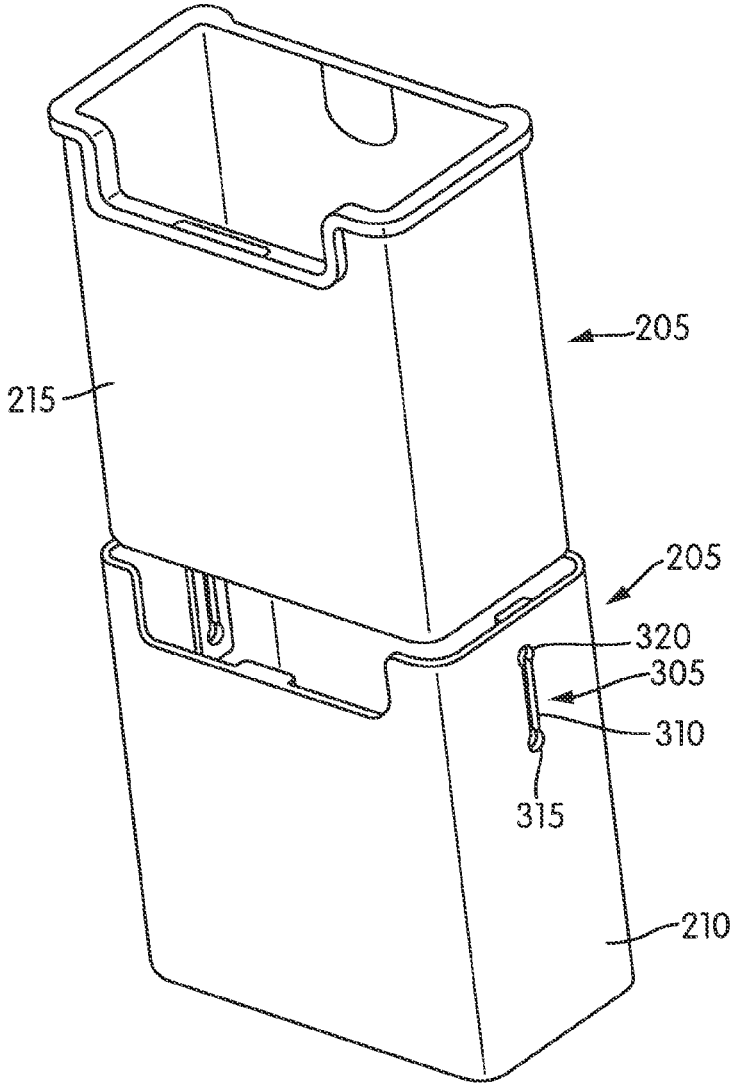
FIG. 21 is an exploded, front perspective view of the remaining components of the cooler of FIG. 20.

With reference to FIGS. 12-19, the cooler 200 also includes a first or bottom cover 225 pivotly coupled to the body 205. The cover 225 is movable between an open position, in which a bottom interior compartment 230 (FIG. 20) is accessible, and a closed position, in which the bottom interior compartment 230 is not accessible. With reference to FIG. 19, the bottom cover 225 includes sunken trays 235 and a recess 240 (FIGS. 16-18) collectively defining a top interior compartment 245. The cooler 200 further includes a second or top cover 250 pivotably coupled to the bottom cover 225. The cover 250 is movable between an open position (FIGS. 15 and 16), in which the top interior compartment 245 of the bottom cover 225 is accessible, and a closed position (FIGS. 12-14), in which the top interior compartment 245 of the bottom cover 225 is not accessible.

Figure 15:
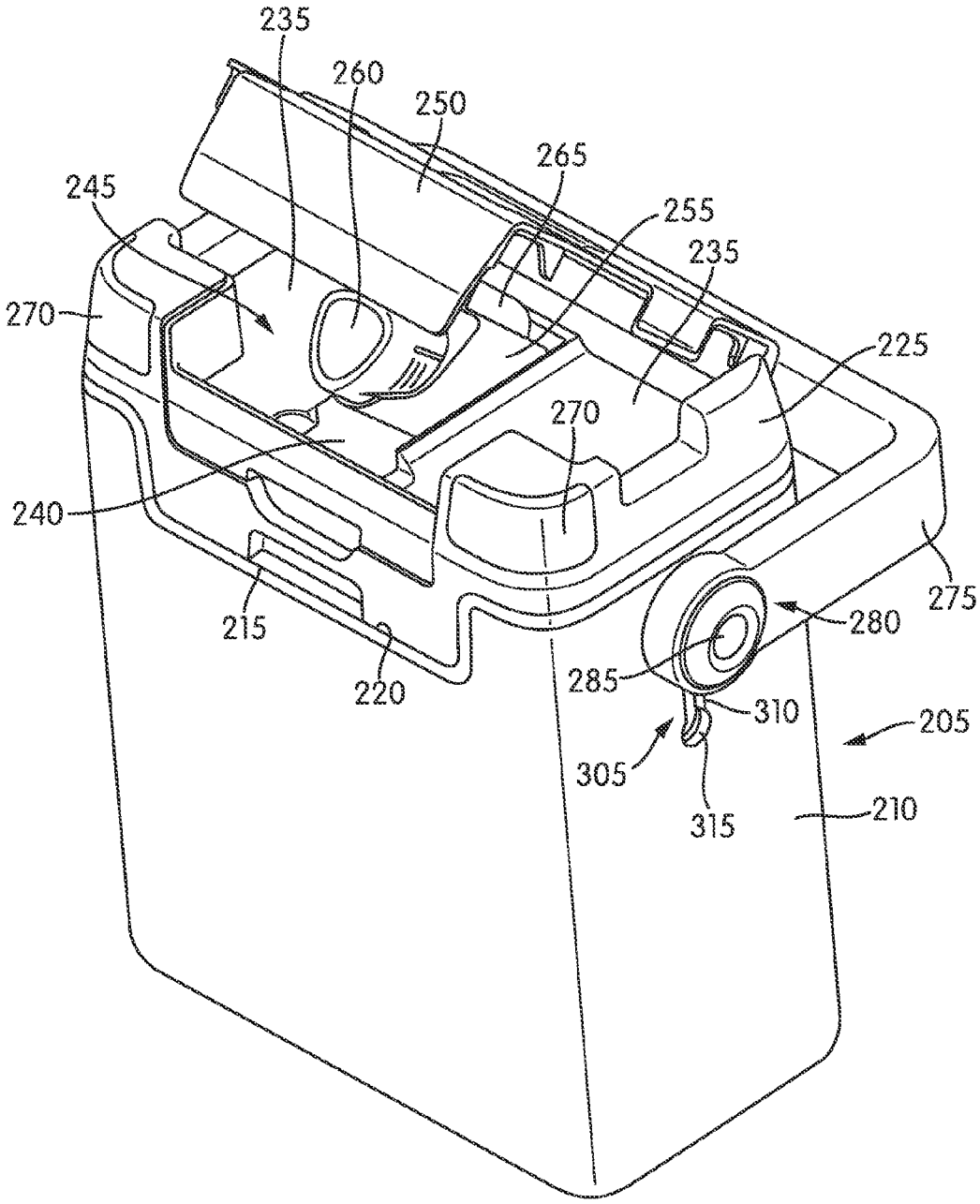
FIG. 15 is a rear perspective view of the cooler of FIG. 12, illustrating a top cover of the cooler in an open position and a battery receptacle in a deployed position.
Figure 16:
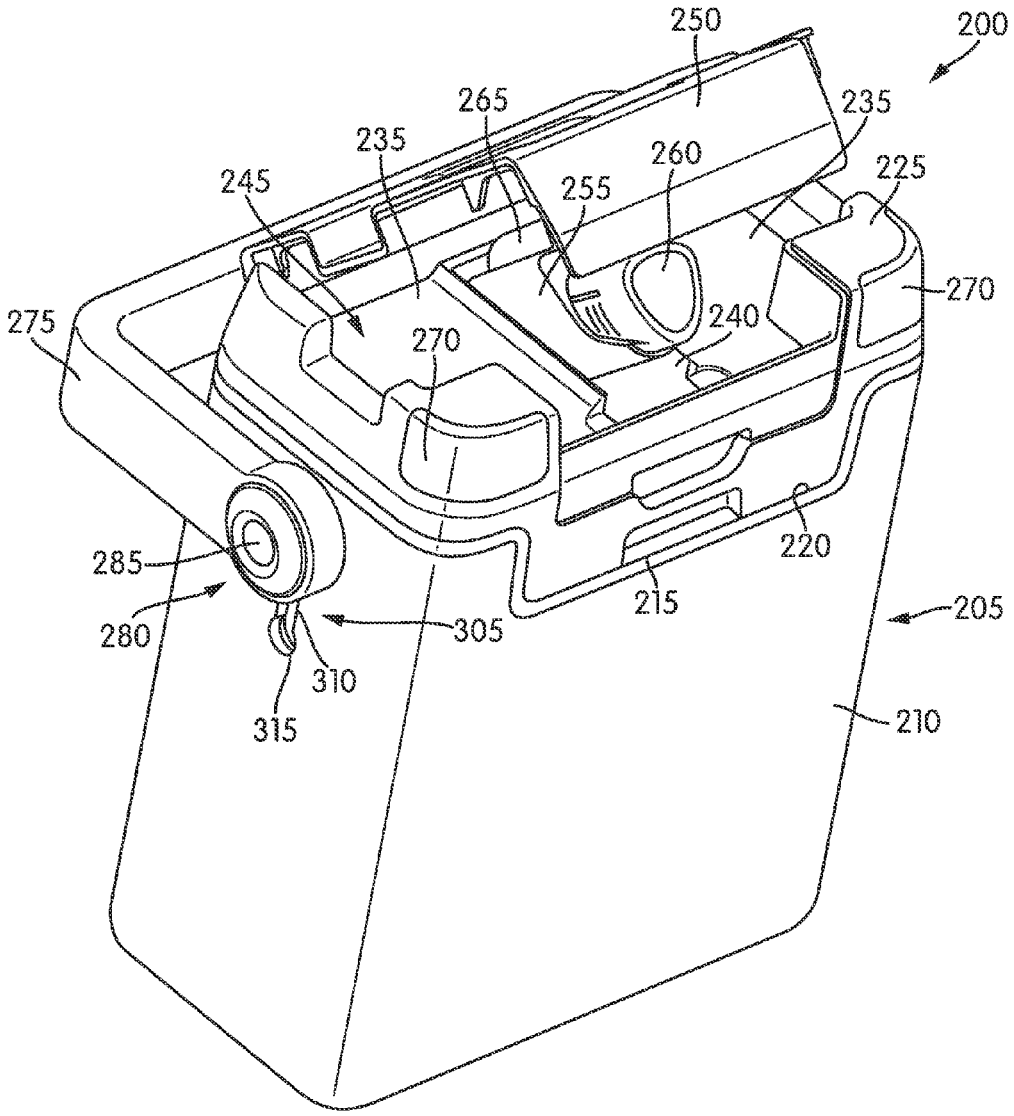
FIG. 16 is another front perspective view of the cooler with the top cover in the open position.

With reference to FIGS. 15 and 16, the cooler 200 further includes a battery receptacle 255 pivotably coupled to the bottom cover 225 and a battery pack 260 removably received within the battery receptacle 255. Particularly, the battery receptacle 255 is pivotably coupled to the bottom cover 225 at a location within the recess 240 of the bottom cover 225. As such, the battery receptacle 255 may be pivoted between a first or deployed position (FIGS. 15 and 16), in which the battery pack 260 is accessible and therefore removable from the battery receptacle 255, and a second or retracted position (FIG. 18), in which the battery pack 260 is contained within the recess 240 and therefore inaccessible for removal from the receptacle 255. To first access the battery pack 260, the top cover 250 must be opened as shown in FIGS. 15 and 16. In the illustrated construction of the cooler 200, the battery pack 260 is configured as a 12-volt power tool battery pack including three lithium-ion battery cells. Alternatively, the battery pack 260 may include fewer or more battery cells to yield any of a number of different output voltages (e.g., 14.4 volts, 18 volts, etc.). Additionally or alternatively, the battery cells may include chemistries other than lithium-ion such as, for example, nickel cadmium, nickel metal-hydride, or the like.

With reference to FIGS. 15, 16, and 19, the battery receptacle 255 includes a protrusion 265 containing a power input (not shown) in electrical communication with the battery pack 260 when it is received within the battery receptacle 255. The power input provides power to an electrical component (e.g., a music device) which, in turn, may be stored in the sunken trays 235 of the top interior compartment 245.

The cooler 200 further includes one or more speakers 270 coupled to the bottom cover 225. Although not shown in the illustrated construction, the cooler 200 includes an auxiliary input. In some constructions, the auxiliary input is located within the top interior compartment 245 of the bottom cover 225. In some constructions, the auxiliary input is contained in the protrusion 265 of the battery receptacle 255 near the power input.

With reference to FIGS. 12-17, the cooler 200 also includes a handle 275 movably coupled to the body 205 between a first position (FIGS. 15 and 16), in which at least the top cover 250 is movable from the closed position to the open position, a second position for transporting the cooler 200, in which the handle 275 is an upright position and at least the op cover 250 is movable from the closed position to the open position, and a third position (FIGS. 12-14), in which the top cover 250 and the bottom cover 225 are maintained in their respective closed positions and prevented from being opened. Although not shown, the bottom cover 225 may also be opened when the handle 275 is in its first position to provide access to the interior compartment 230 of the body 205.

With further reference to FIGS. 12-17, the cooler 200 further includes a locking mechanism 280 which, when actuated from a locked configuration to an unlocked configuration, allows the handle 275 to be moved from the third position, in which the handle 275 maintains the top cover 250 and the bottom cover 225 closed, to the first or second position, in which the handle 275 is displaced from the top cover 250 and the bottom cover 225 to thereby allow the top cover 250 and the bottom cover 225 to be opened. Particularly, as shown in FIG. 17, the locking mechanism 280 includes a push-button actuator 285 on each side of the handle 275 that a user must depress to unlock the handle 275 from the body 205. Each of the actuators 285 include a shaft 290 having a large-diameter portion 295 and an adjacent small-diameter portion 300. With references to FIGS. 17, 19, and 20, the body 205 includes respective elongated slots 305 each having a middle portion 310 with a width nominally sized to provide a snug, sliding fit between the small-diameter portion 300 of the shaft 290 and the elongated slot 305, and bottom ends 315 each having a width at least as large as the large-diameter portion 295 of the shaft 290. As such, when the large-diameter portions 295 of the respective shafts 290 of the actuators 285 are received in the bottom ends 315 of the slots 305 from the frame of reference of FIGS. 19 and 20, the handle 275 is maintained in the second position and is prevented from being moved upward by the interference between the large-diameter portions 295 of the shafts 290 and the corresponding middle portions 310 of the slots 305.

However, when the large-diameter portions 295 of the respective shafts 290 are displaced from the slots 305 (e.g., by the user pushing the actuators 285 inward against a spring bias), the small-diameter portions 300 of the shafts 290 may slide upward along the middle portions 310 of the slots 305 while the handle 275 is extended from its third position to the first or second position. During this time, the handle 275 may be moved or translated upward from the frame of reference of FIGS. 12-14 to provide a gap between the handle 275 and the top cover 250 and bottom cover 225, and then pivoted away from the top cover 250 and bottom cover 225, or both the top cover 250 and bottom cover 225 as one unit, to be opened. The actuators 285 may be released at any time while the handle 275 is being displaced upwardly such that immediately upon the large-diameter portion 295 of each of the shafts 290 encountering a top end 320 of the slots 305 to thereby lock the handle 275 in its first position. As shown in FIGS. 15 and 16, the handle 275 may be pivoted relative to the body 205 while the handle 275 is in its first or second position.

Optionally, the locking mechanism 280 may include a combination or key lock in conjunction with one of the push-button actuators 285 to allow the user to securely store valuable within the bottom interior compartment 230 and the top interior compartment 245 of the cooler 200.

Figure 12:
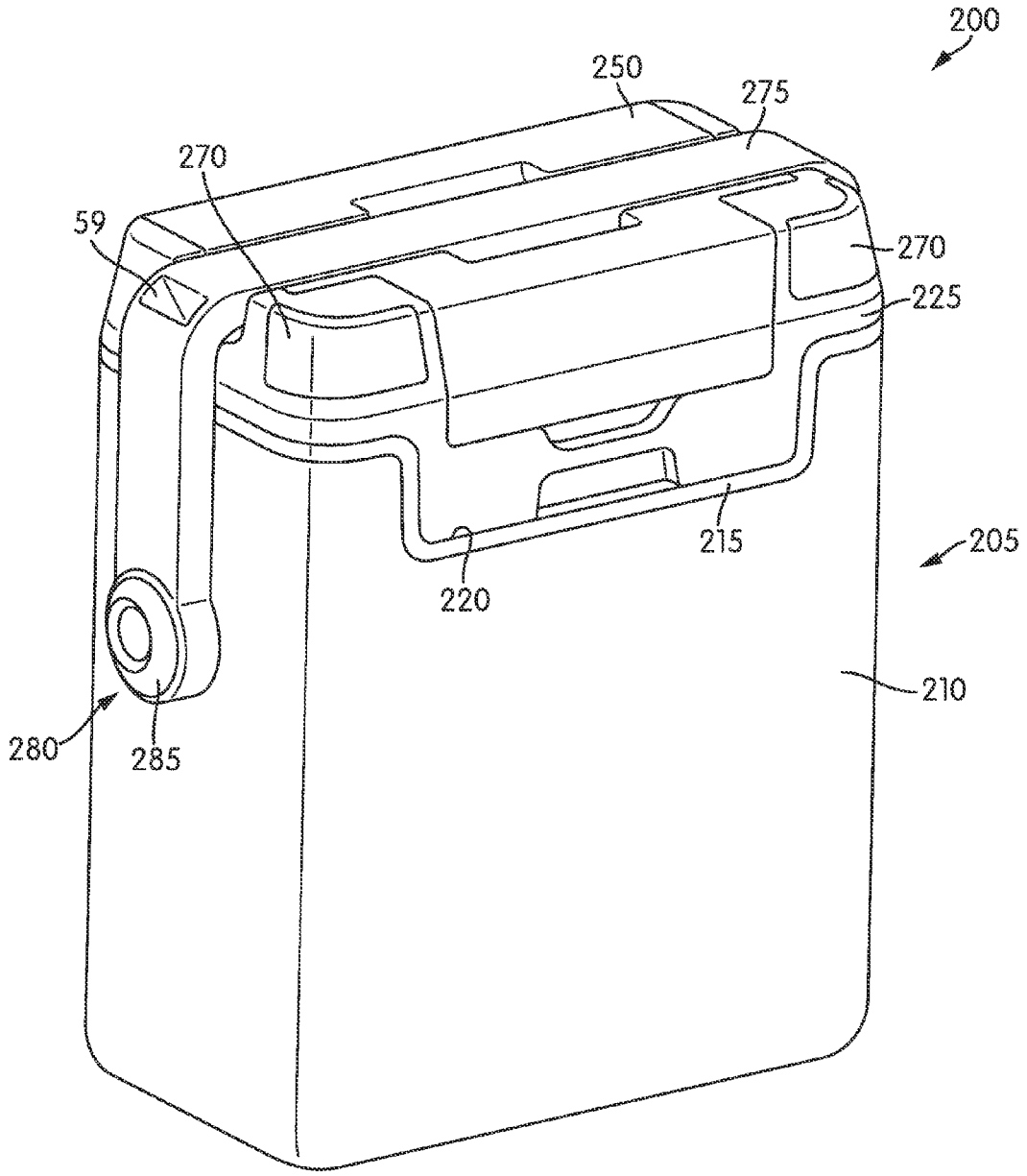
FIG. 12 is a front perspective view of a cooler according to another construction of the invention.
Figure 13:
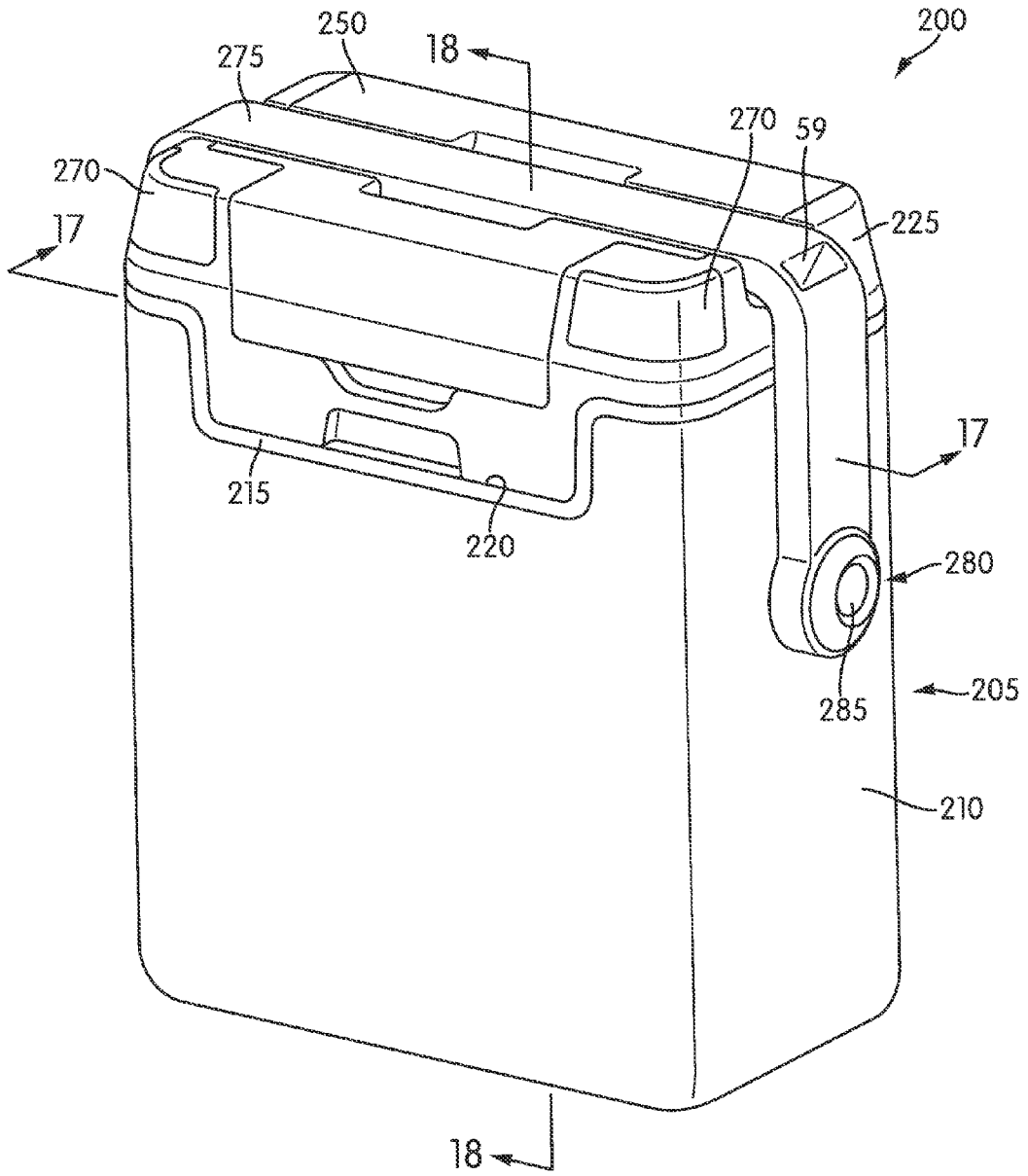
FIG. 13 is another front perspective view of the cooler of FIG. 12.
Figure 14:
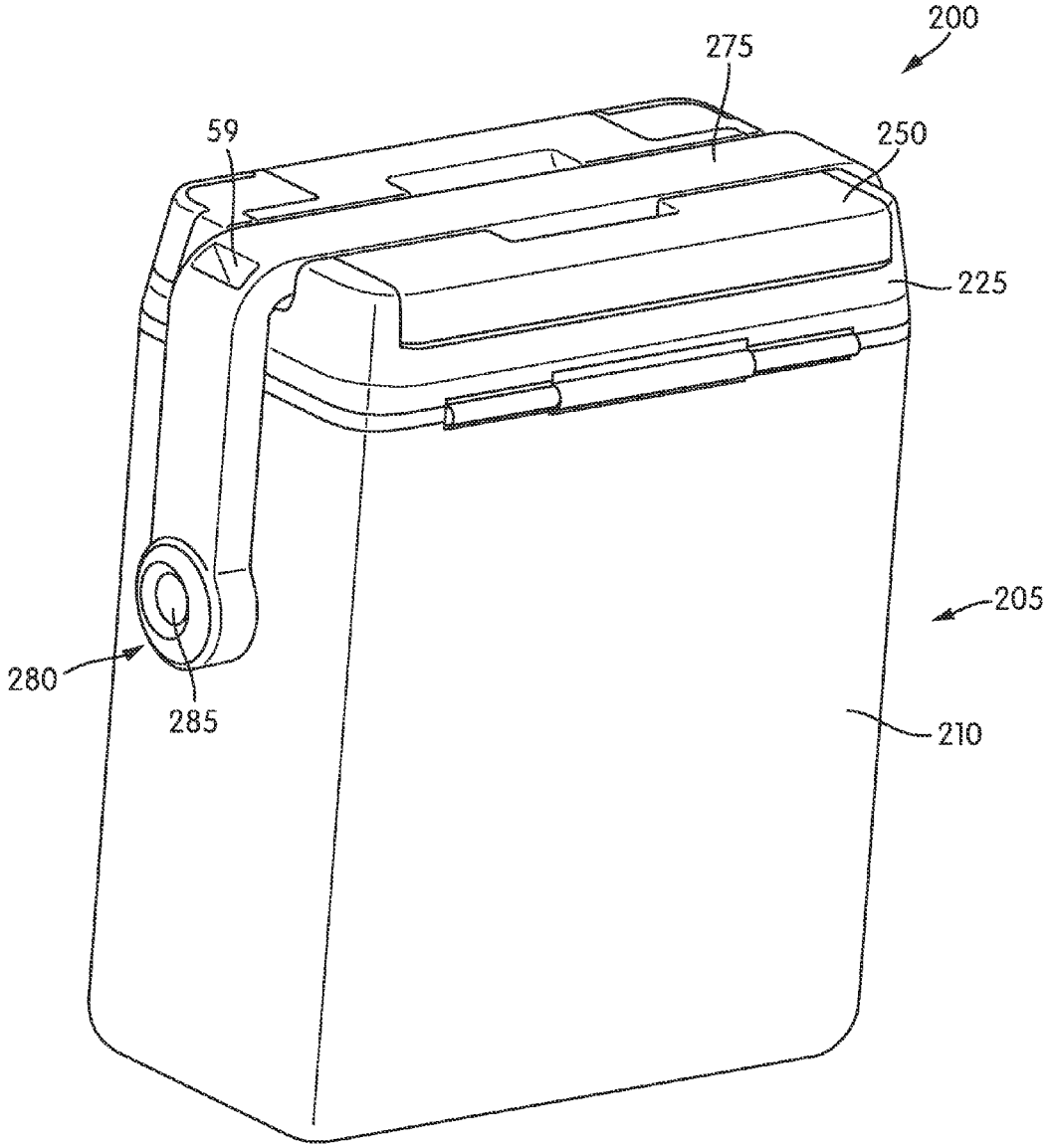
FIG. 14 is a rear perspective view of the cooler of FIG. 12.

With reference to FIGS. 12 and 13, the handle 275 also includes spaced apertures 59 through which opposite ends of a flexible strap (not shown) may protrude.

Figure 22:
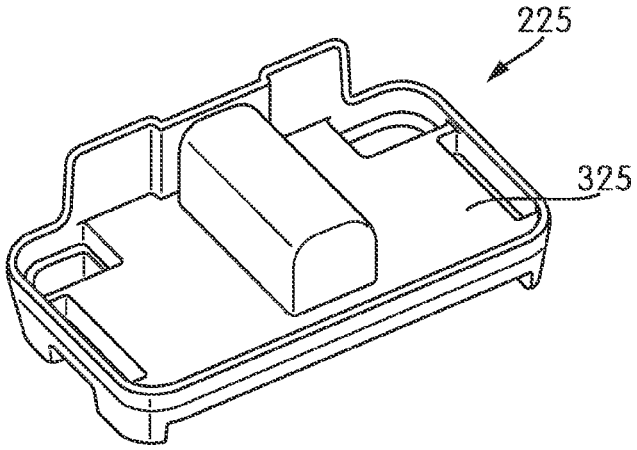
FIG. 22 is a bottom perspective view of an intermediate cover of the cooler shown in FIG. 19.

When the bottom cover 225 is opened and pivoted about 180 degrees, an underside 325 (FIG. 22) of the bottom cover 225 may be used as a table or temporary support surface upon which items may be placed.

Thus, the invention provides, among other things, a cooler. Various features and advantages of the invention are set forth in the following claims.

What is claimed is:

1. A cooler comprising:

a bottom portion including a body defining an insulated first compartment; and a top portion including a first cover operable to enclose the first compartment, the first cover including a cover body defining a second compartment, and a second cover operable to enclose the second compartment;

a power input positioned within the second compartment; and a battery positioned within the second compartment and electrically connected with the power input, wherein the second compartment includes a battery receptacle, wherein the battery receptacle is operable to receive the battery, and wherein the battery receptacle is pivotably attached to the cover body.

2. The cooler of claim 1 wherein the first cover is pivotably coupled to the bottom portion.

3. The cooler of claim 1 wherein the second cover is pivotably coupled to the first cover.

4. The cooler of claim 1 wherein the cover body further includes a power output operable to provide power to an electronic device.

5. The cooler of claim 4 wherein the power output is positioned within the second compartment.

6. The cooler of claim 1 wherein the second compartment includes a dry storage area and a battery storage area.

7. The cooler of claim 1 further including a handle.

8. The cooler of claim 7 wherein the handle has a first position wherein the handle allows the first cover and the second cover to open, a second position wherein the handle allows the first cover and the top second cover to open and a user to transport the cooler via the handle, and a third position wherein the handle prevents the first cover and the second cover from opening.

9. The cooler of claim 7 wherein the handle includes a locking mechanism.

10. The cooler of claim 9 wherein the locking mechanism includes a push-button actuator.

11. The cooler of claim 9 wherein the locking mechanism includes one of a combination lock and a key lock.

12. The cooler of claim 1 wherein the battery receptacle has a first position wherein the battery is removable from the battery receptacle and a second position wherein the battery is not removable from the battery receptacle.

13. The cooler of claim 1 further comprising a speaker supported by the bottom portion or the top portion.

14. The cooler of claim 13 wherein the speaker is powered by the battery.

15. The cooler of claim 1 further comprising an auxiliary input operable to connect with a secondary device.

16. The cooler of claim 15 wherein the auxiliary input is positioned within the second compartment.

17. The cooler of claim 15 wherein an audio signal is inputted to the auxiliary input by the secondary device, and outputted by a speaker.

* * * * *